United States Patent [19]

Baertschi et al.

[11] Patent Number: 4,535,515

[45] Date of Patent: Aug. 20, 1985

[54] DRAW-ROLL ASSEMBLY

[75] Inventors: Peter Baertschi, Kriens; Kurt Wetter, Weinfelden-Hagenbuch; Felix Graf, Winterthur, all of Switzerland

[73] Assignee: Rieter Machine Works, Ltd., Winterthur, Switzerland

[21] Appl. No.: 436,388

[22] Filed: Oct. 25, 1982

[30] Foreign Application Priority Data

Oct. 29, 1981 [CH] Switzerland ..... 6913/81

[51] Int. Cl.[3] ..... D02J 1/22

[52] U.S. Cl. ..... 28/245

[58] Field of Search ..... 28/245, 246; 425/66, 425/DIG. 53; 226/90; 242/47.03, 18 A, 18 R, 18 DD, 18 G; 264/290.5, 290.7

[56] References Cited

U.S. PATENT DOCUMENTS

| | | | |
|---|---|---|---|
| 2,900,220 | 8/1959 | Shaw | 425/66 X |
| 3,379,809 | 4/1968 | Woods | 264/290.5 X |
| 3,817,061 | 6/1974 | Bruner | 28/245 X |
| 4,043,718 | 8/1977 | Takenaka et al. | 28/246 X |
| 4,305,551 | 12/1981 | Cockshott et al. | 242/18 A X |
| 4,311,285 | 1/1982 | Peckinpaugh et al. | 242/18 PM |
| 4,351,492 | 9/1982 | Aoyama et al. | 242/18 R |
| 4,421,282 | 12/1983 | McKinney, III | 242/18 G |

FOREIGN PATENT DOCUMENTS

| | | | |
|---|---|---|---|
| 640867 | 5/1962 | Canada | 264/290.5 |
| 0080568 | 6/1983 | European Pat. Off. | 264/290.5 |

*Primary Examiner*—Werner H. Schroeder
*Assistant Examiner*—Andrew M. Falik
*Attorney, Agent, or Firm*—Kenyon & Kenyon

[57] ABSTRACT

A draw-roll assembly is movable downwardly on guide rods from a working position into a filament take-up position. A slightly heavier counter weight connected with the draw-roll assembly by means of a cable ensures that the draw-roll assembly stays in the upper position even upon failure of a pneumatic control and also that the movement forces are limited substantially to the difference between the weights. An electro-pneumatic control controls the movement speed of the draw-roll assembly from the filament take up position into the working position.

16 Claims, 6 Drawing Figures

Figure 4:
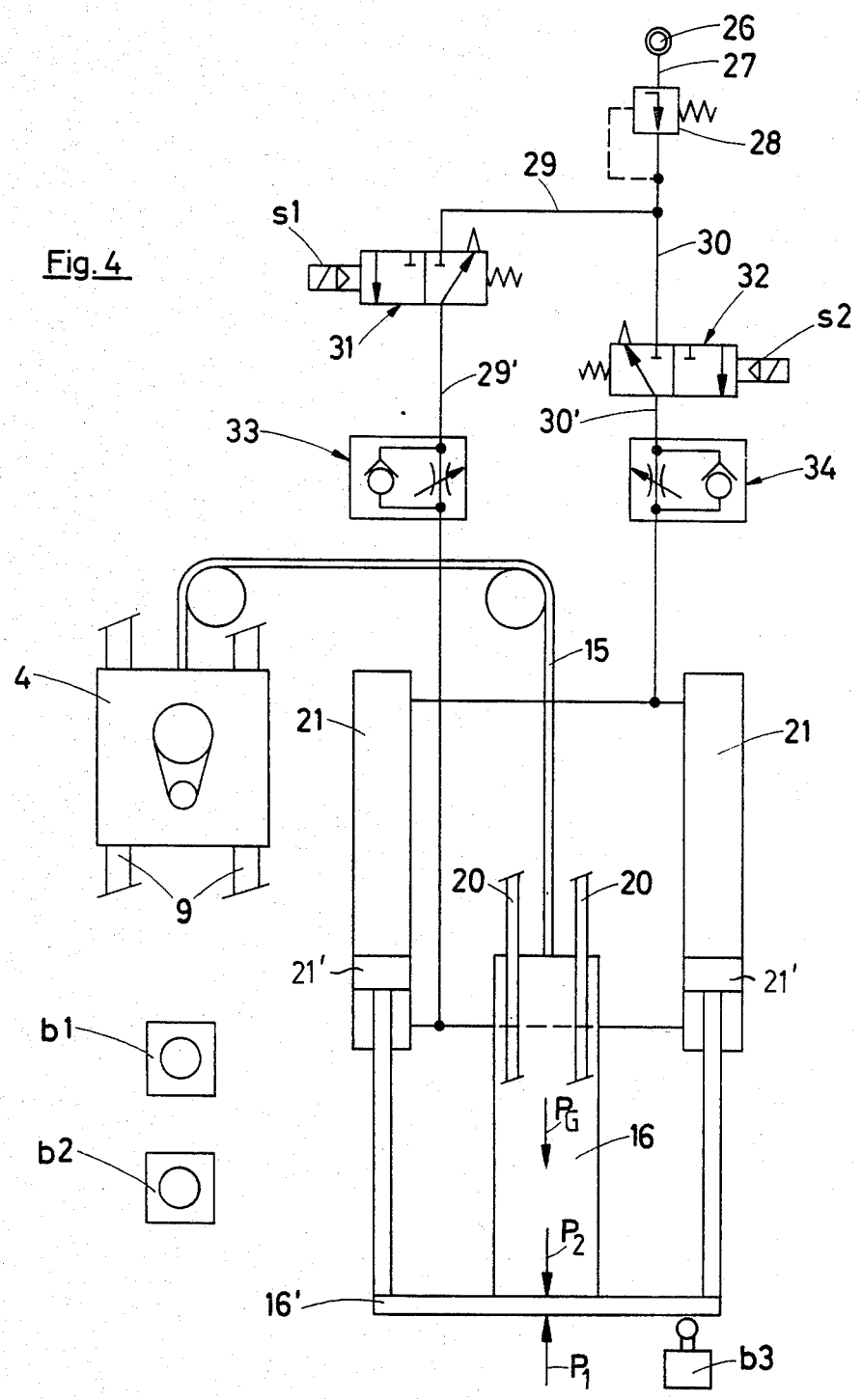

Fig. 1
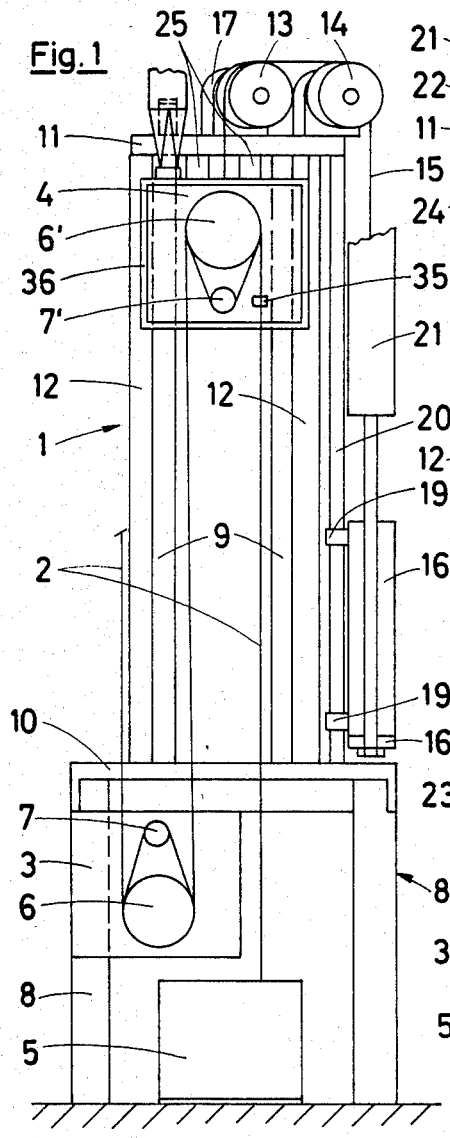
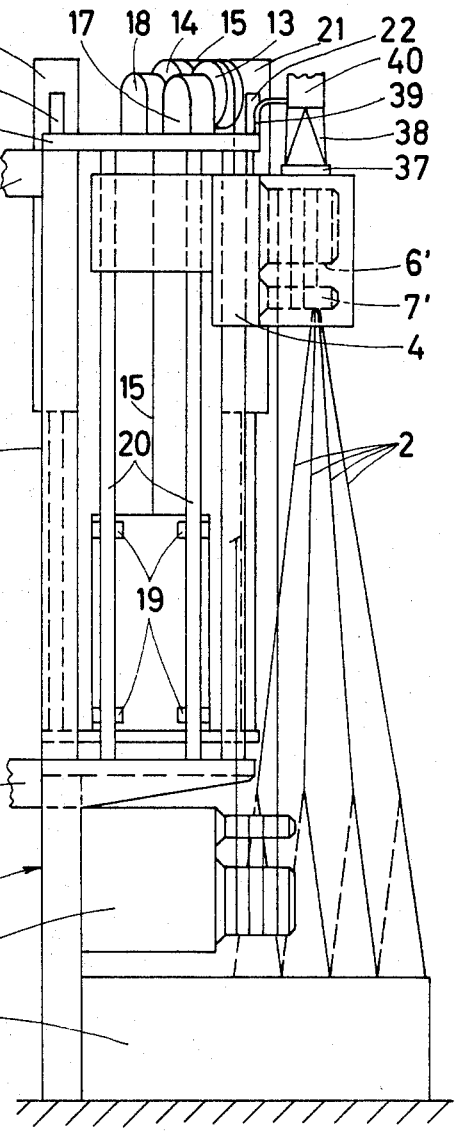
Fig. 2
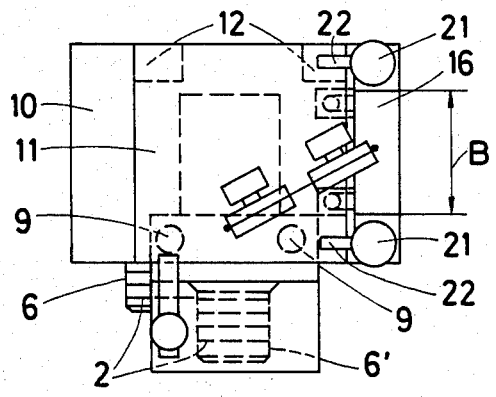
Fig. 3

DRAW-ROLL ASSEMBLY

This invention relates to a draw-roll assembly. More particularly, this invention relates to a draw-roll assembly for a draw-winding or spin-draw-winding machine.

As is known, machines for drawing threads of synthetic material have generally been of the draw-winding type or spin-draw-winding type. In either case, the machines have been provided with draw-roll assemblies for drawing the filamentary material during travel through the machine.

In practice, in order to lay multifilamentary threads to be drawn on the draw-roll assemblies or to finally thread the threads into a winding unit, the filaments are taken up by a manually guided suction pistol and are laid by an operator on the draw-roll assembly or in the winding unit. The multifilamentary thread taken up by the suction pistol can be delivered either from a spin-shaft or from a supply package. The words "multifilamentary thread" means here a plurality of gathered, endless individual fibrils.

If the draw-roll assemblies are located at such heights above the ground that laying of the filament without auxiliary means for overcoming this height is not possible, for example to enable the distribution of several multifilament threads in a winding device with small diversion angles or to enable a long drawing zone, use has been made of mobile steps or raisable stages to enable the laying of the filament by the operator. However, such a mode of operation has the disadvantage that careful guiding of the suction pistol and simultaneous climbing of steps is complicated for the operator. On the other hand, the use of raisable stages is relatively expensive. Further, with careless use of the suction pistol, primarily during laying of fine titers, a filament break can arise which, for example, can result in formation of a lap winding on the preceding galette of a draw-roll assembly and the consequent need to remove the lap. A further danger resides in the possibility of damage to the draw-roll surfaces by a careless use of the suction pistol.

Accordingly, it is an object of the invention to permit a laying in of multifilamentary threads in a draw frame without requiring an operator to use mobile steps of raisable stages.

It is another object of the invention to provide a draw-roll assembly which can be moved between a raised working position and a lowered filament take-up position.

It is another object of the invention to provide a relatively simple control means for moving a draw-roll assembly within a draw frame to permit a laying on of multifilament threads.

Briefly, the invention is directed to a draw frame for filamentary material which has a draw-roll assembly for drawing filamentary material and a plurality of guides for guiding the draw-roll assembly between an abutment defining a raised working position and a lowered filament take-up position. In addition, means are provided for controlling the movement of the draw-roll assembly between the two positions.

The means for controlling the movement of the draw-roll assembly includes a counterweight which is attached to the draw-roll assembly, at least one pressure cylinder which is connected with the counterweight for selectively raising and lowering the counterweight and control means for activating the pressure cylinder.

With this arrangement, an operator, without changing position, can serve all the draw-roll assemblies which are mounted on a draw frame as well as in the assemblies for piecing of filament located in the vicinity of a winding device.

In addition, the control means for controlling the movement of the draw-roll assembly is used to control the speed of movement of the draw-roll assembly so that thread breaks can be avoided.

Figure 5:
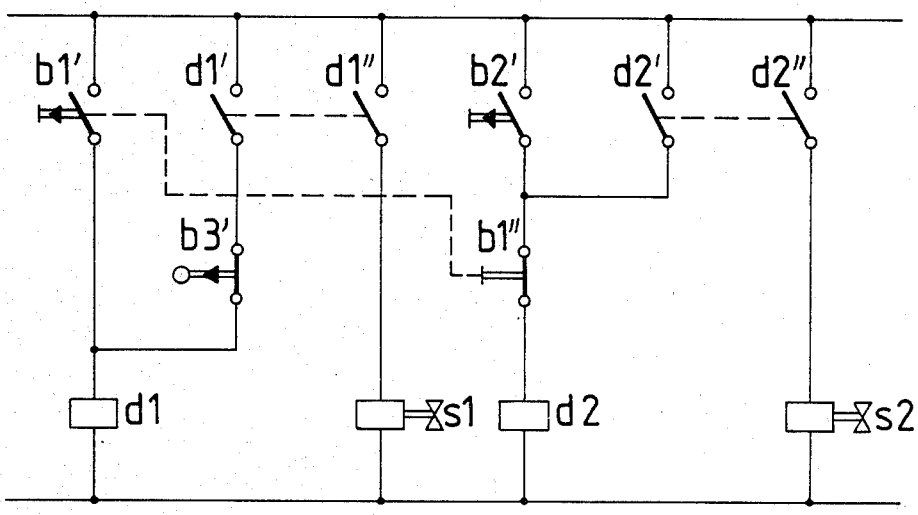
Figure 6:
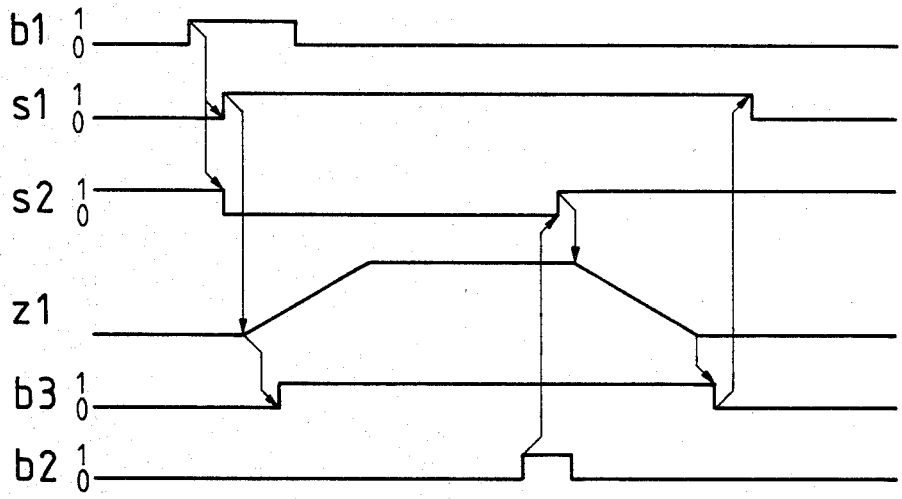

These and other objects and advantages of the invention will become more apparent from the following detailed description taken in conjunction with the accompanying drawings wherein:

FIG. 1 schematically illustrates a front view of a draw frame having a draw-roll assembly in accordance with the invention;

FIG. 2 schematically illustrates a side view of the frame of FIG. 1;

FIG. 3 illustrates a part schematic plan view of the frame of FIG. 1;

FIG. 4 diagramatically illustrates a control means for controlling the movement of a draw-roll assembly in accordance with the invention;

FIG. 5 schematically illustrates a wiring circuit for the control means in accordance with the invention; and FIG. 6 graphically illustrates a function diagram of the control means in accordance with the invention.

Referring to FIG. 1 to 3, the draw frame 1 is constructed for use in a draw-winding or spin-draw-winding machine. The frame 1 receives a bundle 2 of multifilamentary threads, for example comprised of four individual multi-filamentary threads which are supplied from a supply package (not shown) or a spin shaft (not shown).

As shown in FIG. 1, the frame 1 mounts a pair of draw-roll assemblies 3, 4 therein as well as a winding unit 5. As indicated, the bundle 2 of threads is guided about the draw-roll assemblies 3, 4 and is delivered to the winding unit 5.

Each draw-roll assembly 3, 4 is comprised of a galette 6, 6′ and a separator roller 7, 7′ on which each individual multifilamentary thread is guided in a known manner.

The lower draw-roll assembly 3 is fixedly mounted in a carrier frame 8 of the draw frame 1 while the upper draw-roll assembly 4 is guided in guide means in the form of a pair of guide rods 9 for movement in a substantially vertical direction between a raised working position and a lowered filament take-off position. As indicated in FIG. 1, the guide rods 9 are supported at the lower ends on and are connected to a support plate 10 which forms part of the carrier frame 8. The rods 9 are fixed at the upper ends to a cover plate 11 which, in turn, is supported and fixed by carriers 12 which are supported by and connected with the support plate 10.

A means for controlling the movement of the upper draw-roll assembly 4 between the working position and the take-off position is also provided. This means includes a counterweight 16 which is attached to the draw-roll assembly 4 by a cable 15. As shown, the cable 15 is guided over a pair of rollers 13, 14 which are rotatably mounted in suitable bearings 17, 18 fixed to the cover plate 11. In addition, the counterweight 16 is guided via glide elements 19 which are secured thereon and which enage rails 20 which are connected to and between the support plate 10 and cover plate 11. The counterweight 16 also has a yoke 16′ provided at the underside which projects beyond the width B of the counterweight 16.

The control means for controlling the movement of the draw-roll assembly also includes a pair of pressure cylinders 21 which are connected to the yoke 16' of the counterweight 16. Each pressure cylinder 21 is also connected at the upper end via stays 22 with the cover plate 11. The pressure cylinders 21 are activated via a pneumatic control means as described below.

Referring to FIG. 2, the draw frame 1 is secured to a wall (not shown) or another support construction (not shown) via braces 23, 24 which are secured to the carrier frame 8 or the carriers 12, respectively. In addition, in the working position, the draw-roll assembly 4 abuts against abutments 25 which are secured to the underside of the plate 11.

Referring to FIG. 4, the pneumatic control means for activating the pressure cylinders 21 so as to raise and lower the counterweight 16 and thus the upper draw-roll assembly 4 includes a source 26 of pressure medium such as air. As indicated, a pressure air line 27 leads from the source 26 via a pressure reducing valve 28 to a pair of pressure air leads 29, 30. As shown, each lead 29, 30 extends to an electro-pneumatically controlled 3/2-way pneumatic valve 31, 32, each having a so-called block-null-position. A lead 29', 30' leads from each valve 31, 32 to an adjustable throttle-check valve 33, 34, respectively. These throttle valves 33, 34 are constructed in such a manner that the exhaustion of the leads 29' 30' is throttled.

As shown in FIG. 4, each pressure cylinder 21 is double acting with the lower ends of each cylinder connected to the air lead 29' for feeding air to the respective cylinders 21 for raising the counterweight 16. Likewise, the upper ends of each cylinder 21 are connected to the lead 30' for feeding each cylinder with air to effect a downward movement of the counterweight 16.

The control means also includes a pair of electrical impulse pressure button switches b1, b2 together with an end switch b3 which indicates the lower end position of the counterweight 16.

The control functions in the following manner:

In the working position of the draw-roll assembly 4, that is in the starting position of the control, the draw-roll assembly 4 is in the upper end position against the abutments 25 and the counter weight 16 is in the lower position illustrated in FIGS. 1, 2 and 4.

In this starting condition of the control, a relay, d2 (FIG. 5) is activated, the relay contacts d2' and d2'' belonging thereto are closed and the magnetic coil s2 of the valve 32 is activated. Thus, the valve 32 is brought into the through-flow position so that the cylinders 21 are supplied with pressure air via the pressure lead 30'. At the same time, the pressure lead 29' is exhausted via the valve 31 which is in the null-block position (FIG. 4), so that the cylinders 21 are not supplied with pressure air on the piston-rod side.

If now after a thread break or during new laying of a multifilamentary thread or a bundle of multifilamentary threads, the draw roll assembly 4 is to be brought into the lower end position, that is to rest against the carrier plate 10, then the impulse switch b1 (FIG. 4) is operated manually so that the switch contacts b1' (FIG. 5) are closed and the switch contacts b1'' are opened. Thus, on the one hand, relay d2 drops out, relay contacts d2' and d2'' are opened, no current flows in magnetic coil s2 and, thus, the valve 32 is brought into the null-block position. On the other hand, a relay d1 is activated and thereby the relay contacts d1' and d1'' are closed whereby the magnetic coil s1 of the valve 31 is activated and, thus, the valve 31 is moved out of the block position into the through-flow position. By these means, the pressure lead 30' is exhausted and the pressure lead 29' as well as the piston-rod side of each cylinder 21 is supplied with pressure air. The cylinders 21 now move the weight 16 upwards with a speed throttled by means of the valve 34.

During this upward movement, the switch contacts b3' are closed so that the closed relay contact d1' can perform a self-hold function for the relay d1.

After laying of the bundle of multifilamentary threads on the galettes 6, 6' and separating rollers 7, 7' of the draw-roll assemblies 3, 4, threading up of a thread guide 35 (FIG. 1) fixedly mounted on the draw-roll assembly 4 and threading into the winding unit 5, the operator operates the pulse switch b2. Relay d2 is activated thereby and relay contacts d2' and d2'' are closed whereby the self-hold function for the relay d2 is satisfied and the magnetic coil s2 of the valve 32 is activated. That is, valve 32 is moved out of the block-null-position into the through-flow position. Cylinders 21 are thereby supplied with pressure air via lead 30'.

The pistons 21' of the cylinders 21 are now supplied with the same air pressure on both sides. The piston force on the piston-rod side is however smaller than on the opposite side in correspondence with the piston-rod cross-section. Hence, the force $P_{abw}$ available for the downward movement of the weight 16 corresponds to the difference between the sum of the weight $P_G$ of the counterweight 16 and the downwardly directed piston force $P_2$ and the upwardly directed piston force $P_1$ ($P_{awb}=P_2+P_G-P_1$). The downward movement of the weight 16 is therefore throttled in speed by means of the valve 33.

If the draw-roll assembly 4 has reached the upper end position, that is resting against the abutments 25, then the end switch b3 is operated by the yoke 16'. The relay d1 then drops out and thereby the self-hold function for the relay d1 produced by the relay contact d1' is interrupted, and the valve 31 is moved back again into the block-null-position by the opening of the relay contact d1''. In this position of the valve, the pressure lead 29' is exhausted and the piston-rod side of each cylinder 21 is relieved.

The control has thereby achieved once again its starting condition.

The draw-roll assembly 4 is now pressed against the abutments 25 by the weight $P_G$ plus the piston force $P_2$.

The described control procedure is further represented by the function diagram in FIG. 6. As represented there, 1=IN and 0=OUT. The other references relate to the already mentioned elements of the control.

Referring to FIGS. 1 and 2, a heat insulating cabinet 36 covers over the upper draw-roll assembly 4. The upper wall of the cabinet 36 above the gellete 6' carries a connector shaft 37 or the like which communicates the interior of the cabinet 36 with the exterior. This shaft 37 cooperates with a vapor suction nozzle 38 which engages with the shaft when the draw-roll assembly 4 is in the working position in order to permit the exhaust of vapor from the cabinet 36.

In order to achieve a sealing effect between the nozzle 38 and the shaft 37, the nozzle 38 is mounted on the cover plate 11 via a resilient support 39. Thus, when the draw-roll assembly 4 is in the working position, the nozzle 38 is engaged tightly against the inner edge (not specifically indicated) of the connection shaft 37 under the force of the tensioned support 39.

As indicated in FIGS. 1 and 2, the vapor suction nozzle 38 is connected to a suction tube 40 which is provided in known manner with a flexible tube portion (not shown) so that the nozzle 38 can follow the movement of the resilient support 39.

The invention thus provides a draw-roll assembly which can be raised and lowered in a convenient manner from a raised working position to a lowered filament take-up position. The control means for moving the mobile draw-roll assembly can be readily activated by an operator so that a take-up operation can be conveniently performed.

The invention further provides a control means for moving the draw-roll assembly in a controlled manner so as to prevent thread breaks. To this end, the counterweight 6 is made heavier than the draw-roll assembly 4 and the pressure cylinders are dimensioned to generate a force at least greater than the difference in weight between the counterweight 16 and the draw-roll assembly. In addition, the air through the valves 33, 34 can be throttled.

What is claimed is:

1. In combination with a draw frame for filamentary material;

a pair of draw-roll assemblies for drawing filamentary material; and a plurality of guides for guiding one of said draw-roll assemblies from an abutment defining a working position to a filament take-up position adjacent the other of said draw-roll assemblies to permit a laying on of filamentary material.

2. The combination as set forth in claim 1 which further comprises means for controlling the movement of said draw-roll assembly between said positions.

3. The combination as set forth in claim 2 wherein said means includes a counterweight attached to said draw-roll assembly, at least one pressure cylinder connected with counterweight for selectively raising and lowering said counterweight, and control means for activating said pressure cylinder.

4. The combination as set forth in claim 3 wherein said counterweight is heavier than said draw-roll assembly and said pressure cylinder is dimensioned to generate a force at least greater than the difference in weight between said counterweight and said draw-roll assembly.

5. The combination as set forth in claim 4 wherein said cylinder is double-acting and said control means includes valve means for selectively supplying a pressure medium to one side of said cylinder for lifting said counterweight and to an opposite side of said cylinder for holding said draw roll assembly against said abutment.

6. The combination as set forth in claim 5 wherein said control means further includes means for throttling the pressure medium emerging from said cylinder.

7. The combination as set forth in claim 1 which further comprises a heat insulating cabinet covering said draw roll assembly, a connector shaft communicating with an interior of said cabinet, and a vapor suction nozzle for engaging with said shaft in said working position to exhaust vapor from said cabinet.

8. The combination as set forth in claim 7 which further comprises a fixedly mounted cover plate on said frame and a resilient support mounting said suction nozzle on said plate.

9. In combination, a frame;

a first draw-roll assembly for drawing filamentary threads fixedly mounted in a lower portion of said frame;

guide means mounted on said frame; and a second draw roll assembly mounted in said guide means for movement between a raised working position and a lowered filament threading-up position whereby said threads can be easily wrapped about each said draw-roll assembly.

10. The combination as set forth in claim 9 which further comprises means for controlling the movement of said second draw-roll assembly between said positions.

11. The combination as set forth in claim 10 wherein said means includes a counterweight and a cable securing said counterweight to said second draw roll assembly.

12. The combination as set forth in claim 11 wherein said means further includes a pair of pressure cylinders connected to and between said counterweight and said frame and control means for activating said cylinders for raising and lowering said counterweight to control the speed of movement of said second draw-roll assembly.

13. In combination with a draw frame for filamentary material, a guide means for guiding a first draw roll assembly between an abutment defining a working position and a threading up position adjacent to a second draw roll assembly whereby said filamentary material can be easily wrapped around both draw roll assemblies.

14. In combination with a draw frame for filamentary material, a draw-roll assembly for drawing filamentary material;

a plurality of guides for guiding said draw-roll assembly between an abutment defining a working position and a filament take-up position;

means for controlling the movement of said draw-roll assembly between said positions, said means including a counterweight attached to said draw-roll assembly, at least one pressure cylinder connected with counterweight for selectively raising and lowering said counterweight, and control means for activating said pressure cylinder.

15. In combination with a draw frame for filamentary material, a draw-roll assembly for drawing filamentary material;

a plurality of guides for guiding said draw-roll assembly between an abutment defining a working position and a filament take-up position;

a heat insulating cabinet covering said draw roll assembly, a connector shaft communicating with an interior of said cabinet; and a vapor suction nozzle for engaging with said shaft in said working position to exhaust vapor from said cabinet.

16. The combination as set forth in claim 15 which further comprises a fixedly mounted cover plate on said frame and a resilient support mounting said suction nozzle on said plate.

* * * * *